US010995473B2

(12) United States Patent
Takebayashi et al.

(10) Patent No.: US 10,995,473 B2
(45) Date of Patent: May 4, 2021

(54) CONSTRUCTION MACHINE

(71) Applicant: Hitachi Construction Machinery Tierra Co., Ltd., Koka (JP)

(72) Inventors: Yoshifumi Takebayashi, Koka (JP); Hajime Yoshida, Omihachiman (JP); Natsuki Nakamura, Koka (JP); Daisuke Oka, Yasu (JP)

(73) Assignee: Hitachi Construction Machinery Tierra Co., Ltd., Koka (JP)

( * ) Notice: Subject to any disclaimer, the term of this patent is extended or adjusted under 35 U.S.C. 154(b) by 0 days.

(21) Appl. No.: 16/641,712

(22) PCT Filed: Jan. 31, 2019

(86) PCT No.: PCT/JP2019/003503
§ 371 (c)(1),
(2) Date: Feb. 25, 2020

(87) PCT Pub. No.: WO2019/155984
PCT Pub. Date: Aug. 15, 2019

(65) Prior Publication Data

US 2020/0232180 A1 Jul. 23, 2020

(30) Foreign Application Priority Data

Feb. 9, 2018 (JP) ..... JP2018-022422

(51) Int. Cl.
*E02F 3/84* (2006.01)
*E02F 9/22* (2006.01)
(Continued)

(52) U.S. Cl.
CPC ..... *E02F 3/844* (2013.01); *E02F 3/7609* (2013.01); *E02F 3/964* (2013.01); *E02F 9/2004* (2013.01);
(Continued)

(58) Field of Classification Search
None
See application file for complete search history.

(56) References Cited

U.S. PATENT DOCUMENTS 4,166,506 A * 9/1979 Tezuka ..... E02F 3/844 172/4.5
10,094,092 B2 * 10/2018 Joung ..... E02F 9/2207
2017/0211597 A1 7/2017 Vigholm et al.

FOREIGN PATENT DOCUMENTS

JP 6-280287 A 10/1994
JP 2002-88796 A 3/2002
(Continued)

OTHER PUBLICATIONS

JP 2009068173 A machine translation to English from espacenet (Year: 2009).*
(Continued)

*Primary Examiner* — Michael Leslie
*Assistant Examiner* — Michael Quandt
(74) *Attorney, Agent, or Firm* — Crowell & Moring LLP

(57) ABSTRACT

Provided is a construction machine that can prevent a machine body from being lowered without placing a blade in a floating state when the machine body is jacked up, even if the operator performs an erroneous operation, and that can perform favorable leveling work by placing the blade in the floating state when the machine body is not jacked up. A hydraulic excavator includes a pressure sensor that detects the pressure in a bottom-side oil chamber of a blade cylinder, and a controller that switches between validation and invalidation of a floating command and a lowering command for a blade operation device. In the case where the pressure detected by the pressure sensor is less than a predetermined value, the controller switches a solenoid selector valve to an interruption position to invalidate the floating command when a forward stroke of the operation lever is equal to or
(Continued)

more than a reference value. In the case where the pressure detected by the pressure sensor is equal to or more than the predetermined value, the controller holds the solenoid selector valve in a communication position to validate the floating command when the forward stroke of the operation lever is equal to or more than the reference value.

3 Claims, 5 Drawing Sheets

(51) Int. Cl.

| | |
|---|---|
| *E02F 3/76* | (2006.01) |
| *E02F 3/96* | (2006.01) |
| *E02F 9/20* | (2006.01) |

(52) U.S. Cl.

CPC ..... *E02F 9/2203* (2013.01); *E02F 9/226* (2013.01); *E02F 9/2225* (2013.01); *E02F 9/2235* (2013.01); *E02F 9/2267* (2013.01); *E02F 9/2271* (2013.01); *E02F 9/2285* (2013.01); *E02F 9/2292* (2013.01); *E02F 9/2296* (2013.01); *F15B 2211/20576* (2013.01); *F15B 2211/3127* (2013.01); *F15B 2211/31547* (2013.01); *F15B 2211/6313* (2013.01); *F15B 2211/6355* (2013.01); *F15B 2211/67* (2013.01); *F15B 2211/7053* (2013.01); *F15B 2211/7058* (2013.01)

(56) References Cited

FOREIGN PATENT DOCUMENTS

| | | | | |
|---|---|---|---|---|
| JP | 2004-19807 | A | | 1/2004 |
| JP | 2005-207197 | A | | 8/2005 |
| JP | 2009068173 | A | * | 4/2009 |
| JP | 2010-84333 | A | | 4/2010 |

OTHER PUBLICATIONS

International Search Report (PCT/ISA/210) issued in PCT Application No. PCT/JP2019/003503 dated Apr. 9, 2019 with English translation (four (4) pages).

Japanese-language Written Opinion (PCT/ISA/237) issued in PCT Application No. PCT/JP2019/003503 dated Apr. 9, 2019 (four (4) pages).

International Preliminary Report on Patentability (PCT/IB/338 & PCT/IB/373) issued in PCT Application No. PCT/JP2019/003503 dated Aug. 11, 2020, including English translation of document C2 (Japanese-language Written Opinion (PCT/ISA/237) previously filed on Feb. 25, 2020) (eight (8) pages).

* cited by examiner

CONSTRUCTION MACHINE

TECHNICAL FIELD

The present invention relates to a construction machine such as a hydraulic excavator, particularly to a construction machine capable of putting a blade into a floating state.

BACKGROUND ART

Patent Document 1 discloses a construction machine including: a blade provided to be drivable in the vertical direction relative to a machine body; a blade cylinder that is operated by hydraulic fluid delivered from a hydraulic pump and that drives the blade in the vertical direction; and a blade control valve that controls a flow of the hydraulic fluid relative to the blade cylinder. This construction machine is configured such that the blade can be put into a floating state (in other words, a state in which the blade is not fixed). The details thereof will be described below.

In a first related art depicted in FIG. 5 of Patent Document 1, the blade control valve has a floating position for putting the blade in a floating state, in addition to a neutral position for stopping the blade, a raising position for driving the blade in a raising direction, and a lowering position for driving the blade in a lowering position. With an operation lever operated by the operator, the blade control valve is switched from the neutral position to one of the raising position, the lowering position, and the floating position.

In the neutral position of the blade control valve, communication of a rod-side oil chamber of the blade cylinder with the hydraulic pump and a tank is interrupted, and communication of a bottom-side oil chamber of the blade cylinder with the hydraulic pump and the tank is interrupted. In the raising position of the blade control valve, communication of the rod-side oil chamber of the blade cylinder with the hydraulic pump is established, and communication of the bottom-side oil chamber of the blade cylinder with the tank is established. By this, hydraulic fluid from the hydraulic pump is supplied into the rod-side oil chamber of the blade cylinder to contract the blade cylinder, thereby raising the blade. In the lowering position of the blade control valve, communication of the bottom-side oil chamber of the blade cylinder with the hydraulic pump is established, and communication of the rod-side oil chamber of the blade cylinder with the tank is established. By this, the hydraulic fluid from the hydraulic pump is supplied into the bottom-side oil chamber of the blade cylinder to extend the blade cylinder, thereby lowering the blade.

In the floating position of the blade control valve, communication of the rod-side oil chamber and the bottom-side oil chamber of the blade cylinder with the tank is established. By this, the blade is put into a floating state. In this instance, the blade is lowered by its own weight, to make contact with the ground. When the construction machine is traveled forward or backward, the blade can be made to follow up to a rugged shape, if any, of the ground, since the blade is in the floating state. Therefore, leveling work can be performed, with the blade constantly kept in contact with the ground.

In a second related art depicted in FIG. 1 of Patent Document 1, the blade control valve has a switching position added in place of the aforementioned floating position. In the switching position of the blade control valve, communication of the rod-side oil chamber of the blade cylinder with the tank is established, whereas communication of the bottom-side oil chamber of the blade cylinder with the hydraulic pump and the tank is interrupted.

PRIOR ART DOCUMENT

Patent Document

Patent Document 1: JP-2002-088796-A

SUMMARY OF THE INVENTION

Problems to be Solved by the Invention

The blade of the construction machine is used not only in the case of performing leveling work but also in the case of jacking up the machine body, for example, for performing maintenance or cleaning of a chassis of the machine body. In the aforementioned first related art, in the case where the blade control valve is in the floating position, communication of the rod-side oil chamber and the bottom-side oil chamber of the blade cylinder with the tank is established. Therefore, in the case where the operator performs an erroneous operation to switch the blade control valve into the floating position in a state in which the machine body is jacked up, the blade is put into the floating state, causing the machine body to be lowered.

On the other hand, in the aforementioned second related art, in the case where the blade control valve is in the switching position, communication of only the rod-side oil chamber of the blade cylinder with the tank is established. In other words, unlike in the first related art, communication of the bottom-side oil chamber of the blade cylinder with the tank is not established. Therefore, even if the operator performs an erroneous operation to switch the blade control valve to the switching position in a state in which the machine body is jacked up, the blade is not operated in the raising position, and the machine body can be prevented from being lowered.

However, in the second prior art, when the operator performs operation to switch the blade control valve to the switching position with an intention to perform leveling work, communication of the bottom-side oil chamber of the blade cylinder with the tank is not established, and, therefore, the blade is not lowered or is lowered with difficulty by its own weight, so that the blade does not follow up to the undulations of the ground. In other words, favorable leveling work cannot be performed.

It is an object of the present invention to provide a construction machine that can prevent a machine body from being lowered, without putting a blade into a floating state, even if the operator performs an erroneous operation when the machine body is jacked up and that can perform favorable leveling work by putting the blade into the floating state when the machine body is not jacked up.

Means for Solving the Problems

In order to achieve the above object, the present invention provides a construction machine including: a blade provided to be drivable in a vertical direction relative to a machine body; a blade cylinder that is operated by a hydraulic fluid delivered from a hydraulic pump and that drives the blade in the vertical direction; a blade control valve that switches to one of a neutral position for stopping the blade, a raising position for driving the blade in a raising direction, a lowering position for driving the blade in a lowering direction, and a floating position for setting the blade in a floating state, to thereby control a flow of the hydraulic fluid in relation to the blade cylinder; and a blade operation device that has an operation lever, that outputs a raising command for switching the blade control valve to the raising position when the operation lever is operated to one side, that outputs a lowering command for switching the blade control valve to the lowering position when the operation lever is operated to the other side and its stroke is less than a reference value, and that outputs a floating command for switching the blade control valve to the floating position when the operation lever is operated to the other side and its stroke is equal to or more than the reference value. The construction machine includes: a pressure sensor that detects a pressure in a bottom-side oil chamber of the blade cylinder; and a controller that switches between validation and invalidation of the floating command and the lowering command based on a result of detection by the pressure sensor. A predetermined value preset as a pressure in the bottom-side oil chamber of the blade cylinder to be a reference for determining as to whether or not the blade is jacking up the machine body is stored in the controller, and the controller validates the floating command when the operation lever is operated to the other side and its stroke is equal to or more than the reference value, in a case where the pressure detected by the pressure sensor is less than the predetermined value, and invalidates the floating command when the operation lever is operated to the other side and its stroke is equal to or more than the reference value, and invalidates the lowering command until the stroke of the operation lever becomes less than the reference value and the operation lever is operated to the neutral position, in a case where the pressure detected by the pressure sensor is equal to or more than the predetermined value.

Advantages of the Invention

According to the present invention, in the case where the machine body is in a jacked-up state, even if the operator performs an erroneous operation, the floating command is invalidated and the blade is not put into the floating state, whereby the machine body can be prevented from being lowered. On the other hand, in the case where the machine body is not in the jacked-up state, the floating command is validated and the blade is put into the floating state, whereby favorable leveling work can be performed.

MODE FOR CARRYING OUT THE INVENTION

An embodiment of the present invention will be described, taking a hydraulic excavator as an example of an object to which the present invention is applied.

Figure 1:
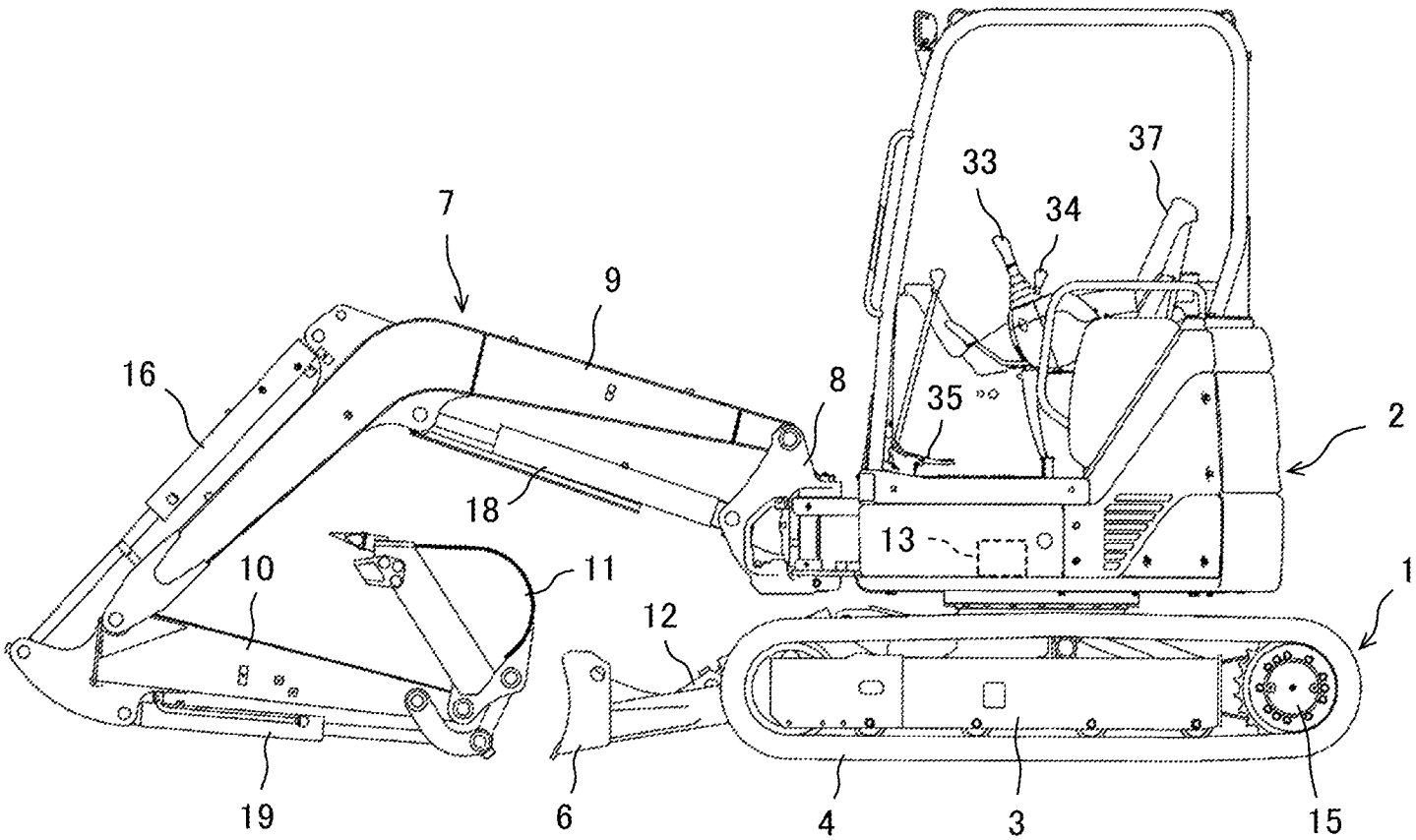
FIG. 1 is a side view representing a structure of a hydraulic excavator in an embodiment of the present invention.

FIG. 1 is a side view representing a structure of the hydraulic excavator in the present embodiment.

The hydraulic excavator of the present embodiment includes a lower track structure 1 capable of self-traveling, and an upper swing structure 2 swingably provided on the upper side of the lower track structure 1, in which the lower track structure 1 and the upper swing structure 2 constitute a machine body. The upper swing structure 2 is swung by a swing motor 13.

The lower track structure 1 has a track frame 3 which is H-shaped as viewed from above. The track frame 3 includes a center frame extending in the left-right direction (the perpendicular direction to the paper surface in FIG. 1), a left side frame provided on the left side (the viewer's side of the paper surface in FIG. 1) of the center frame and extending in the longitudinal machine direction (the left-right direction in FIG. 1), and a right side frame provided on the right side (the depth side of the paper surface in FIG. 1) of the center frame and extending in the longitudinal machine direction.

A left crawler type track device 4 is provided on the left side frame, and is driven by a left track motor 15. A right crawler type track device 5 (see FIG. 5 described later) is provided on the right side frame, and is driven by a right track motor 17 (see FIG. 5 described later). The lower track structure 1 travels by driving of the left and right track devices 4 and 5. A blade 6 is provided to be drivable in the vertical direction (the vertical direction in FIG. 1) relative to the center frame, and is driven in the vertical direction by a blade cylinder 12.

A work device 7 is connected to the front side (the left side in FIG. 1) of the upper swing structure 2. The work device 7 includes a swing post 8 connected rotatably in the left-right direction to the upper swing structure 2, a boom 9 vertically rotatably connected to the swing post 8, an arm 10 vertically rotatably connected to the boom 9, and a bucket 11 vertically rotatably connected to the arm 10. The swing post 8 is rotated in the left-right direction by a swing cylinder 14 (see FIG. 2 described later), and swings the boom 9 in the left-right direction. The boom 9, the arm 10, and the bucket 11 are rotated in the vertical direction by a boom cylinder 18, an arm cylinder 16, and a bucket cylinder 19, respectively.

Figure 2:
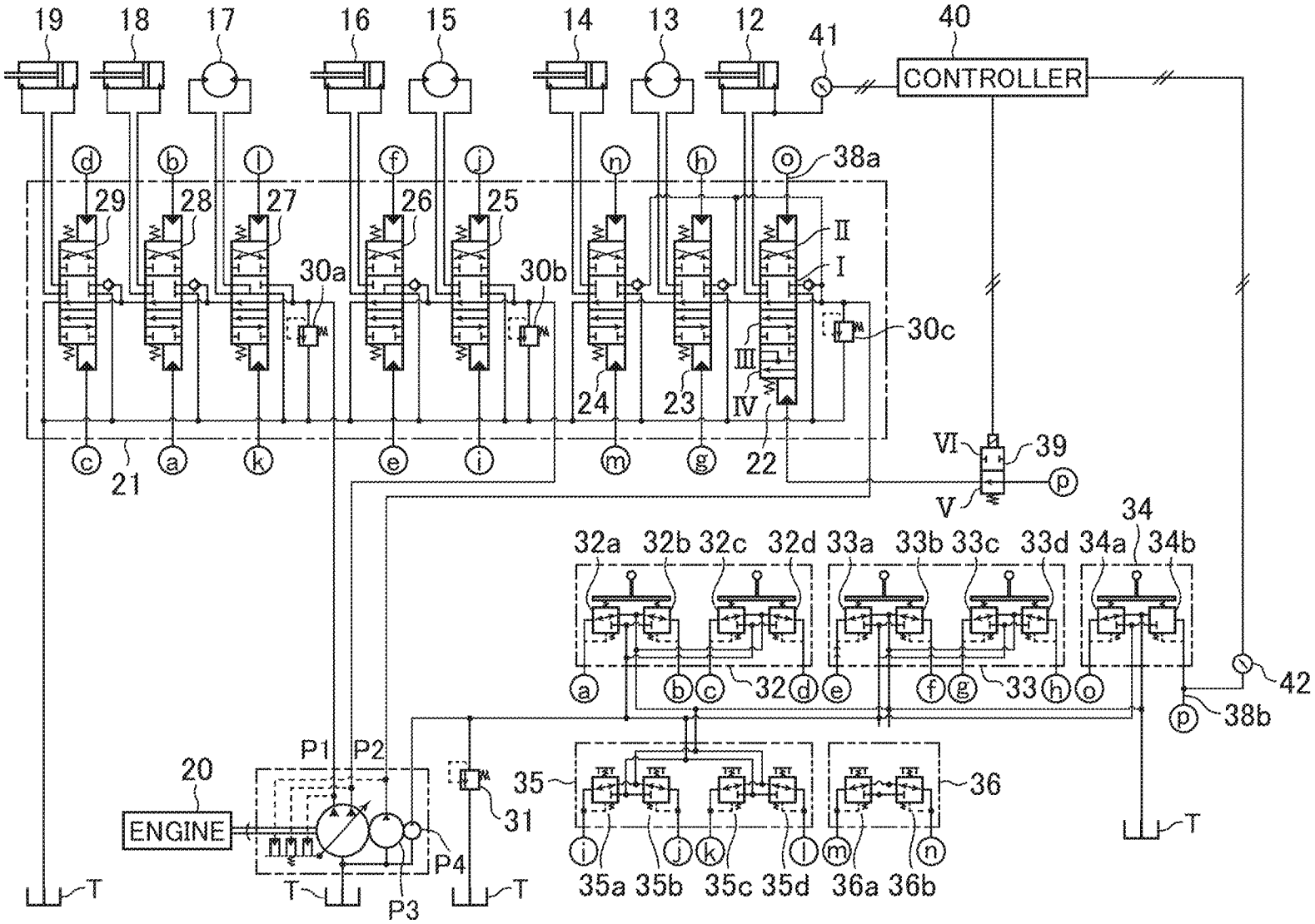
FIG. 2 is a hydraulic circuit diagram representing a configuration of a driving device of the hydraulic excavator in the embodiment of the present invention.

The upper swing structure 2, the track devices 4 and 5, the blade 6, the swing post 8, the boom 9, the arm 10, and the bucket 11 described above constitute driven bodies which are driven by a driving device mounted on the hydraulic excavator. FIG. 2 is a diagram representing a configuration of the driving device of the hydraulic excavator in the present embodiment.

The driving device in the present embodiment includes hydraulic pumps P1, P2, and P3 as main pumps driven by an engine 20 (prime mover), a plurality of actuators (specifically, the right track motor 17, the boom cylinder 18, and the bucket cylinder 19 mentioned above) operated by a hydraulic fluid delivered from the hydraulic pump P1, a plurality of actuators (specifically, the left track motor 15 and the arm cylinder 16 mentioned above) operated by a hydraulic fluid delivered from the hydraulic pump P2, a plurality of actuators (specifically, the blade cylinder 12, the swing motor 13, and the swing cylinder 14 mentioned above) operated by a hydraulic fluid delivered from the hydraulic pump P3, and a valve unit 21. Note that the hydraulic pumps P1 and P2 are split flow type hydraulic pumps.

The valve unit 21 includes: open center type control valves 27, 28, and 29 that control flows of hydraulic fluid from the hydraulic pump P1 to the actuators 17, 18, and 19; open center type control valves 25 and 26 that control flows of hydraulic fluid from the hydraulic pump P2 to the actuators 15 and 16; open center type control valves 22, 23, and 24 that control flows of hydraulic fluid from the hydraulic pump P3 to the actuators 12, 13, and 14; and main relief valves 30*a*, 30*b*, and 30*c* that restrict delivery pressures of the hydraulic pumps P1, P2, and P3.

In addition, the driving device in the present embodiment includes a pilot pump P4 driven by the engine 20, a pilot relief valve 31 that keeps constant the delivery pressure of the pilot pump P4, and operation devices 32 to 36 that operate the control valves 22 to 29. Note that the operation device 33 is disposed on the left side of an operation seat 37 (see FIG. 1) in a cabin of the upper swing structure 2, and the operation devices 32 and 34 are disposed on the right side of the operation seat 37. Besides, the operation devices 35 and 36 are disposed on the front side of the operation seat 37.

The operation device 32 for the boom and the bucket includes a cross operation type operation lever, and pilot valves 32*a* to 32*d* operated according to the operation of the operation lever. The pilot valve 32*a* is operated according to a rear-side operation of the operation lever, generates a boom-raising pilot pressure a based on the delivery pressure of the pilot pump P4, and outputs the boom-raising pilot pressure a to a pressure-receiving section on one side of the boom control valve 28. By this, the boom control valve 28 is switched, and the hydraulic fluid from the hydraulic pump P1 is supplied to a bottom-side oil chamber of the boom cylinder 18, to extend the boom cylinder 18. As a result, the boom 9 is raised.

The pilot valve 32*b* is operated according to a front-side operation of the operation lever, generates a boom-lowering pilot pressure b based on the delivery pressure of the pilot pump P4, and outputs the boom-lowering pilot pressure b to a pressure-receiving section on the other side of the boom control valve 28. By this, the boom control valve 28 is switched, and the hydraulic fluid from the hydraulic pump P1 is supplied to a rod-side oil chamber of the boom cylinder 18, to contract the boom cylinder 18. As a result, the boom 9 is lowered.

The pilot valve 32*c* is operated according to a left-side operation of the operation lever, generates a bucket-crowding pilot pressure c based on the delivery pressure of the pilot pump P4, and outputs the bucket-crowding pilot pressure c to a pressure-receiving section on one side of the bucket control valve 29. By this, the bucket control valve 29 is switched, and the hydraulic fluid from the hydraulic pump P1 is supplied to a bottom-side oil chamber of the bucket cylinder 19, to extend the bucket cylinder 19. As a result, the bucket 11 is crowded.

The pilot valve 32*d* is operated according to a right-side operation of the operation lever, generates a bucket-dumping pilot pressure d based on the delivery pressure of the pilot pump P4, and outputs the bucket-dumping pilot pressure d to a pressure-receiving section on the other side of the bucket control valve 29. By this, the bucket control valve 29 is switched, and the hydraulic fluid from the hydraulic pump P1 is supplied to a rod-side oil chamber of the bucket cylinder 19, to contract the bucket cylinder 19. As a result, the bucket 11 is dumped.

The operation device 33 for the arm and swing includes a cross operation type operation lever, and pilot valves 33*a* to 33*d* operated according to the operation of the operation lever. The pilot valve 33*a* is operated according to a rear-side operation of the operation lever, generates an arm-pulling pilot pressure e based on the pressure of the pilot pump P4, and outputs the arm-pulling pilot pressure e to a pressure-receiving section on one side of the arm control valve 26. By this, the arm control valve 26 is switched, and the hydraulic fluid from the hydraulic pump P2 is supplied to a bottom-side oil chamber of the arm cylinder 16, to extend the arm cylinder 16. As a result, the arm 10 is pulled in.

The pilot valve 33*b* is operated according to a front-side operation of the operation lever, generates an arm-pushing pilot pressure f based on the pressure of the pilot pump P4, and outputs the arm-pushing pilot pressure f to a pressure-receiving section on the other side of the arm control valve 26. By this, the arm control valve 26 is switched, and the hydraulic fluid from the hydraulic pump P2 is supplied to a rod-side oil chamber of the arm cylinder 16, to contract the arm cylinder 16. As a result, the arm 10 is pushed in.

The pilot valve 33*c* is operated according to a left-side operation of the operation lever, generates a counterclockwise swinging pilot pressure g based on the pressure of the pilot pump P4, and outputs the counterclockwise swinging pilot pressure g to a pressure-receiving section on one side of the swing control valve 23. By this, the swing control valve 23 is switched, and the hydraulic fluid from the hydraulic pump P3 is supplied to a port on one side of the swing motor 13, to rotate the swing motor 13 in one direction. As a result, the upper swing structure 2 is swung counterclockwise.

The pilot valve 33*d* is operated according to a right-side operation of the operation lever, generates a clockwise swinging pilot pressure h based on the pressure of the pilot pump P4, and outputs the clockwise swinging pilot pressure h to a pressure-receiving section on the other side of the swing control valve 23. By this, the swing control valve 23 is switched, and the hydraulic fluid from the hydraulic pump P3 is supplied to a port on the opposite side of the swing motor 13, to rotate the swing motor 13 in the opposite direction. As a result, the upper swing structure 2 is swung clockwise.

The operation device 35 for track includes a left operation member (specifically, an integrated body of an operation lever and an operation pedal) operable in the longitudinal machine direction, pilot valves 35*a* and 35*b* operated according to the operation of the left operation member, a right operation member (specifically, an integrated body of an operation lever and an operation pedal) operable in the longitudinal machine direction, and pilot valves 35*c* and 35*d* operated according to the operation of the right operation member. The pilot valve 35*a* is operated according to a front-side operation of the left operation member, generates a left track pilot pressure i based on the delivery pressure of the pilot pump P4, and outputs the left track pilot pressure i to a pressure-receiving section on one side of the left track control valve 25. By this, the left track control valve 25 is switched, and the hydraulic fluid from the hydraulic pump P2 is supplied to a port on one side of the left track motor 15, to rotate the left track motor 15 in one direction. As a result, the left track device 4 is driven in a traveling direction on one side (normally, a forward traveling direction).

The pilot valve 35*b* is operated according to a rear-side operation of the left operation member, generates a left track pilot pressure j based on the delivery pressure of the pilot pump P4, and outputs the left track pilot pressure j to a pressure-receiving section on the other side of the left track control valve 25. By this, the left track control valve 25 is switched, and the hydraulic fluid from the hydraulic pump P2 is supplied to a port on the opposite side of the left track motor 15, to rotate the left track motor 15 in the opposite direction. As a result, the left track device 4 is driven in a traveling direction on the opposite side (normally, a backward traveling direction).

The pilot valve 35*c* is operated according to a front-side operation of the right operation member, generates a right track pilot pressure k based on the delivery pressure of the pilot pump P4, and outputs the right track pilot pressure k to a pressure-receiving section on one side of the right track control valve 27. By this, the right track control valve 27 is switched, and the hydraulic fluid from the hydraulic pump P1 is supplied to a port on one side of the right track motor 17, to rotate the right track motor 17 in one direction. As a result, the right track device 5 is driven in a traveling direction on one side (normally, a forward traveling direction).

The pilot valve 35*d* is operated according to a rear-side operation of the right operation member, generates a right track pilot pressure l based on the delivery pressure of the pilot pump P4, and outputs the right track pilot pressure l to a pressure-receiving section on the other side of the right track control valve 27. By this, the right track control valve 27 is switched, and the hydraulic fluid from the hydraulic pump P1 is supplied to a port on the opposite side of the right track motor 17, to rotate the right track motor 17 in the opposite direction. As a result, the right track device 5 is driven in a traveling direction on the opposite side (normally, a backward traveling direction).

The operation device 36 for boom swing includes an operation pedal operable in the left-right direction, and pilot valves 36*a* and 36*b* operated according to the operation of the operation pedal. The pilot valve 36*a* is operated according to a left-side operation of the operation pedal, generates a boom counterclockwise swinging pilot pressure m based on the delivery pressure of the pilot pump P4, and outputs the boom counterclockwise swinging pilot pressure m to a pressure-receiving section on one side of the boom swing control valve 24. By this, the boom swing control valve 24 is switched, and the hydraulic fluid from the hydraulic pump P3 is supplied to a bottom-side oil chamber of the swing cylinder 14, to extend the swing cylinder 14. As a result, the boom 9 is swung counterclockwise together with the swing post 8.

The pilot valve 36*b* is operated according to a right-side operation of the operation pedal, generates a boom clockwise swinging pilot pressure n based on the delivery pressure of the pilot pump P4, and outputs the boom clockwise swinging pilot pressure n to a pressure-receiving section on the other side of the boom swing control valve 24. By this, the boom swing control valve 24 is switched, and the hydraulic fluid from the hydraulic pump P3 is supplied to a rod-side oil chamber of the swing cylinder 14, to contract the swing cylinder 14. As a result, the boom 9 is swung clockwise together with the swing post 8.

Note that, in the case where the operation lever of the operation device 32 is not operated and the right operation member of the operation device 35 is not operated, the control valves 27, 28, and 29 are in neutral positions, and, therefore, the hydraulic fluid delivered from the hydraulic pump P1 is returned to a tank T through the control valves 27, 28, and 29. In the case where the left operation member of the operation device 35 is not operated and the operation lever of the operation device 33 is not operated in the longitudinal machine direction, the control valves 25 and 26 are in neutral positions, and, therefore, the hydraulic fluid delivered from the hydraulic pump P2 is returned to the tank T through the control valves 25 and 26. In the case where the operation lever of the operation device 34 for blade described later is not operated and the operation lever of the operation device 33 is not operated in the left-right direction and the operation pedal of the operation device 36 is not operated, the control valves 22, 23, and 24 are in neutral positions, and, therefore, the hydraulic fluid delivered from the hydraulic pump P3 is returned to the tank T through the control valves 22, 23, and 24.

Here, the driving device in the present embodiment is configured such that the blade 6 can be put into a floating state. Specifically, the blade control valve 22 has a floating position IV for putting the blade 6 into a floating state, in addition to a neutral position I for stopping the blade 6, a raising position II for driving the blade 6 in a raising direction, and a lowering position III for driving the blade 6 in a lowering direction. By the operation of the blade operation device 34, the blade control valve 22 is switched from the neutral position I to one of the raising position II, the lowering position III, and the floating position IV.

The blade operation device 34 includes an operation lever operable in the longitudinal machine direction, and pilot valves 34*a* and 34*b* operated according to the operation of the operation lever. The pilot valve 34*a* is operated according to an operation of the operation lever from a neutral position to the rear side, generates a pilot pressure o (corresponding to a raising command) based on the pressure of the pilot pump P4, and outputs the pilot pressure o to a pressure-receiving section on one side of the blade control valve 22 through a pilot hydraulic line 38*a*. By this, the blade control valve 22 is switched from the neutral position I to the raising position II, and the hydraulic fluid from the hydraulic pump P3 is supplied to a rod-side oil chamber of the blade cylinder 12, to contract the blade cylinder 12. As a result, the blade 6 is raised.

Figure 3:
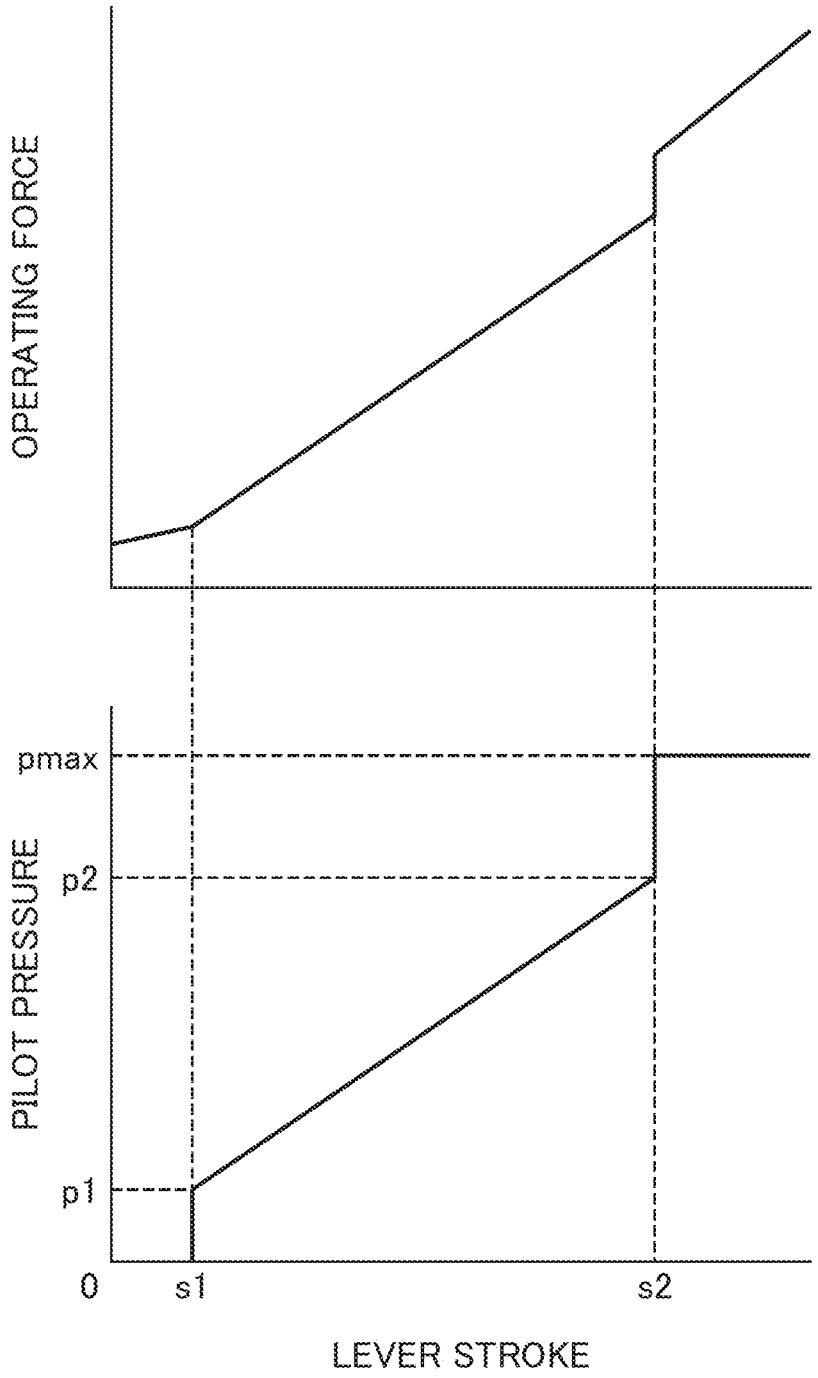
FIG. 3 is a diagram representing a relation between lever stroke and pilot pressure of a blade operation device in the embodiment of the present invention.

The pilot valve 34*b* is operated according to an operation of the operation lever from the neutral position to the front side, and generates a pilot pressure p based on the pressure of the pilot pump P4. Specifically, as depicted in FIG. 3, when the operation lever is in the neutral position (dead zone), that is, when a lever stroke s at the time of operating the operation lever to the front side is less than a predetermined value s1, the pilot pressure p is set to zero, and when the lever stroke s is at the predetermined value s1, the pilot pressure p is set to a predetermined value p1. Besides, when the lever stroke s is equal to or more than the predetermined value s1 but less than a reference value s2 (provided that $s2>s1$), the pilot pressure p is gradually increased as the lever stroke s is gradually enlarged. The pilot pressure p in this instance is in the range of $p2>p\geq p1$, and corresponds to a lowering command.

When the lever stroke s is equal to or more than the reference value s2 (in other words, when a detent position at which an operating force necessary for operating the operation lever is abruptly increased is reached), the pilot pressure p is abruptly raised to a maximum value pmax. The pilot pressure p (=pmax) in this instance corresponds to a floating command. Note that p2 or pmax is a preset determination value (reference pilot pressure); while $p2<pmax$ is adopted in the present embodiment, a condition of $p2=pmax$ may also be adopted.

The pilot valve 34*b* outputs the pilot pressure p generated as aforementioned to a pressure-receiving section on the other side of the blade control valve 22 through a pilot hydraulic line 38*b*. In the case where the pilot pressure p is equal to or more than the predetermined value p1 but less than the determination value p2 (that is, in the case where the pilot pressure p corresponds to a lowering command), the blade control valve 22 is switched from the neutral position I to the lowering position III, and the hydraulic fluid from the hydraulic pump P3 is supplied to a bottom-side oil chamber of the blade cylinder 12, to extend the blade cylinder 12. As a result, the blade 6 is lowered. Note that as the pilot pressure p is gradually raised, an opening area of a meter-in line and an opening area of a meter-out line at the lowering position III of the blade control valve 22 are gradually enlarged.

In the case where the pilot pressure p is the maximum value pmax (that is, in the case where the pilot pressure p corresponds to a floating command), the blade control valve 22 is switched to the floating position IV, to cause a bottom-side oil chamber and a rod-side oil chamber of the blade cylinder 12 to communicate with the tank T. By this, the blade 6 is put into a floating state.

In addition, in the present embodiment, the driving device includes a solenoid selector valve 39 provided in the pilot hydraulic line 38*b*, and a controller 40 that controls the solenoid selector valve 39. The controller 40 includes a calculation control section (e.g., CPU) that performs a calculation process and a control process based on a program, and a storage section (e.g., ROM or RAM) that stores the program and the results of the calculation process.

The solenoid selector valve 39 can be switched to a communication position V and an interruption position IV. In the case where the solenoid selector valve 39 is in the communication position V, the pilot pressure p can be outputted from the blade operation device 34 to the pressure-receiving section on the other side of the blade control valve 22, and the pilot pressure p is validated. On the other hand, in the case where the solenoid selector valve 39 is in the interruption position VI, the pilot pressure p cannot be outputted from the blade operation device 34 to the pressure-receiving section on the other side of the blade control valve 22, and the pilot pressure p is invalidated.

In addition, in the present embodiment, a pressure sensor 41 that detects the pressure in the bottom-side oil chamber of the blade cylinder 12 is provided. A predetermined value (setting value) preset as a pressure in the bottom-side oil chamber of the blade cylinder 12 to be a reference for determining as to whether or not the blade 6 is jacking up the machine body is stored in the controller 40, and the controller 40 compares the result of detection by the pressure sensor 41 with the predetermined value. Besides, a pilot pressure sensor 42 is provided in the pilot hydraulic line 38*b*. A neutral pilot pressure (predetermined value) preset as a pilot pressure p to be a reference for determining as to whether or not the operation lever of the blade operation device 34 has been operated to a neutral position and a reference pilot pressure (determination value) preset as a pilot pressure p to be a reference for determining as to whether or not the operation lever of the blade operation device 34 has been operated to the front side and its stroke is equal to or more than the reference value s2, are stored in the controller 40, and the controller 40 compares the result of detection by the pilot pressure sensor 42 with these pressures.

Figure 4:
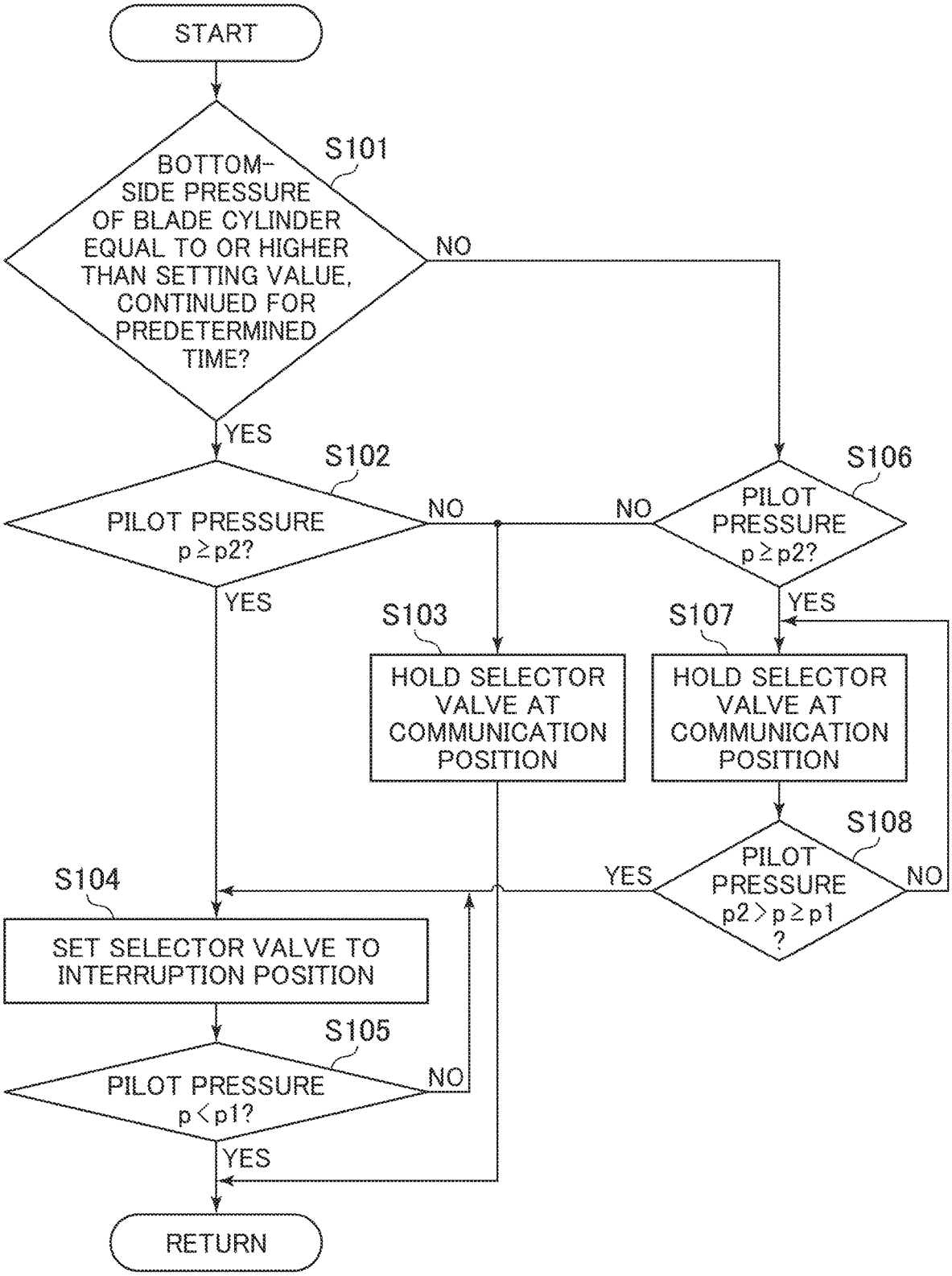
FIG. 4 is a flow chart representing a processing procedure of a controller in the embodiment of the present invention.

Next, the contents of processing by the controller 40 in the present embodiment will be described. FIG. 4 is a flow chart representing a processing procedure of the controller in the present embodiment.

First, in step S101, the controller 40 determines whether or not the pressure in the bottom-side oil chamber of the blade cylinder 12 is equal to or more than a preset setting value (e.g., 10 MPa) and that state has continued for a preset predetermined period of time (e.g., several minutes). When the pressure in the bottom-side oil chamber of the blade cylinder 12 is equal to or more than the setting value and that state has continued for the predetermined period of time, it means that the blade 6 is jacking up the machine body.

For example, in the case where the pressure in the bottom-side oil chamber of the blade cylinder 12 is equal to or more than the setting value and that state has continued for the predetermined period of time, in other words, in the case where the blade 6 is jacking up the machine body, the determination in step S101 is YES, and the control proceeds to step S102. In step S102, the controller 40 determines whether or not the pilot pressure p detected by the pilot pressure sensor 42 is equal to or more than the determination value p2. When the pilot pressure p detected by the pilot pressure sensor 42 is equal to or more than the determination value p2, it means that the operation lever of the blade operation device 34 has been operated from the neutral position to the front side and its stroke s is equal to or more than the reference value s2.

For example, in the case where the pilot pressure p detected by the pilot pressure sensor 42 is less than the determination value p2, in step S102, in other words, in the case where the lever stroke s is less than the reference value s2, the determination in step S102 is NO, and the control proceeds to step S103. In step S103, the controller 40 sets the control signal for the solenoid selector valve 39 to OFF, to thereby hold the solenoid selector valve 39 in the communication position V. By this, a pilot pressure p corresponding to a lowering command is validated. Thereafter, the control returns to step S101, and the aforementioned processing is conducted.

For example, in the case where the pilot pressure p detected by the pilot pressure sensor 42 is equal to or more than the determination value p2, in step S102, in other words, in the case where the lever stroke s is equal to or more than the reference value s2, the determination in step S102 is YES, and the control proceeds to step S104. In step S104, the controller 40 sets the control signal for the solenoid selector valve 39 to ON, to thereby switch the solenoid selector valve 39 to the interruption position VI. By this, a pilot pressure p corresponding to a floating command is invalidated.

Thereafter, the control proceeds to step S105, in which the controller 40 determines whether or not the pilot pressure p detected by the pilot pressure sensor 42 has become less than the predetermined value p1. When the pilot pressure p detected by the pilot pressure sensor 42 is less than the predetermined value p1, it means that the operation lever of the blade operation device 34 has been operated to a neutral position. For example, in the case where the pilot pressure p detected by the pilot pressure sensor 42 is not less than the predetermined value p1, in step S105, in other words, in the case where the operation lever of the blade operation device 34 has not been returned to the neutral position, the determination in step S105 is NO, and the control returns to step S104. In other words, the controller 40 holds the solenoid selector valve 39 in the interruption position VI. By this, the floating command and the lowering command are invalidated, until the operation lever of the blade operation device 34 is returned to the neutral position.

For example, in the case where the pilot pressure p detected by the pilot pressure sensor 42 has become less than the predetermined value p1, in step S105, in other words, in the case where the operation lever of the blade operation device 34 has been returned to the neutral position, the determination in step S105 is YES, and the control returns to step S101. Thereafter, since the operation lever of the blade operation device 34 has been returned to the neutral position, the control proceeds to step S103 via step S101 and step S102 (or step S106 described later). In step S103, the controller 40 switches the solenoid selector valve 39 to the communication position V.

For example, in the case where the pressure in the bottom-side oil chamber of the blade cylinder 12 is less than the setting value, or in the case where the pressure in the bottom-side oil chamber of the blade cylinder 12 is equal to or more than the setting value but that state has not continued for the predetermined period of time, in step S101, in other words, in the case where the blade 6 is not jacking up the machine body, the determination in step S101 is NO, and the control proceeds to step S106. In step S106, as in step S102, the controller 40 determines whether or not the pilot pressure p detected by the pilot pressure sensor 42 is equal to or more than the predetermined value p2.

For example, in the case where the pilot pressure p detected by the pilot pressure sensor 42 is less than the determination value p2, in step S106, in other words, in the case where the lever stroke s is less than the reference value s2, the determination in step S106 is NO, and the control proceeds to step S103. In step S103, the controller 40 sets the control signal for the solenoid selector valve 39 to OFF, to thereby hold the solenoid selector valve 39 in the communication position V. By this, a pilot pressure p corresponding to the lowering command is validated. Thereafter, the control returns to step S101, and the aforementioned processing is performed.

For example, in the case where the pilot pressure p detected by the pilot pressure sensor 42 is equal to or more than the determination value p2, in step S106, in other words, in the case where the lever stroke s is equal to or more than the reference value s2, the determination in step S106 is YES, and the control proceeds to S107. In step S107, as in step S103, the controller 40 sets the control signal for the solenoid selector valve 39 to ON, to thereby hold the solenoid selector valve 39 in the communication position V. By this, a pilot pressure p corresponding to the floating command is validated.

Thereafter, the control proceeds to step S108, in which the controller 40 determines whether or not the pilot pressure detected by the pilot pressure sensor 42 is equal to or more than the predetermined value p1 but less than the determination value p2. When the pilot pressure p detected by the pilot pressure sensor 42 has become equal to or more than the predetermined value p1 but less than the determination value p2, it means that the pilot pressure p has changed from the floating command to the lowering command. For example, in the case where the pilot pressure p detected by the pilot pressure sensor 42 is equal to or more than the determination value p2, in step S108, in other words, in the case where the pilot pressure p remains to be the floating command, the determination in step S108 is NO, and the control returns to step S107. In other words, the controller 40 holds the solenoid selector valve 39 in the communication position V.

For example, in the case where the pilot pressure p detected by the pilot pressure sensor 42 has become equal to or more than the predetermined value p1 but less than the determination value p2, in step S108, in other words, in the case where the pilot pressure p has changed from the floating command to the lowering command, the determination in step S108 is YES, and the control proceeds to step S104. In step S104, the controller 40 sets the control signal for the solenoid selector valve 39 to ON, to thereby switch the solenoid selector valve 39 to the interruption position VI. By this, the pilot pressure p corresponding to the lowering command is invalidated.

Thereafter, the control proceeds to step S105, in which the controller 40 determines whether or not the pilot pressure p detected by the pilot pressure sensor 42 has become less than the predetermined value p1. For example, in the case where the pilot pressure p detected by the pilot pressure sensor 42 has not become less than the predetermined value p1, in step S105, in other words, in the case where the operation lever of the blade operation device 34 has not been returned to the neutral position, the determination in step S105 is NO, and the control returns to step S104. In other words, the controller 40 holds the solenoid selector valve 39 in the interruption position VI. By this, the lowering command is invalidated until the operation lever of the blade operation device 34 is returned to the neutral position.

For example, in the case where the pilot pressure p detected by the pilot pressure sensor 42 has become less than the predetermined value p1, in step S105, in other words, in the case where the operation lever of the blade operation device 34 has been returned to the neutral position, the determination in step S105 is YES, and the control returns to step S101. Thereafter, since the operation lever of the blade operation device 34 has been returned to the neutral position, the control proceeds to step S103 via step S101 and step S102 or S106. In step S103, the controller 40 switches the solenoid selector valve 39 to the communication position V.

Next, operations and effects of the present embodiment will be described. The blade 6 of the hydraulic excavator is used, for example, in the case of jacking up the machine body for maintenance or cleaning of a chassis of the machine body or in the case of performing leveling work.

(1) Jack-Up of Machine Body

Figure 5:
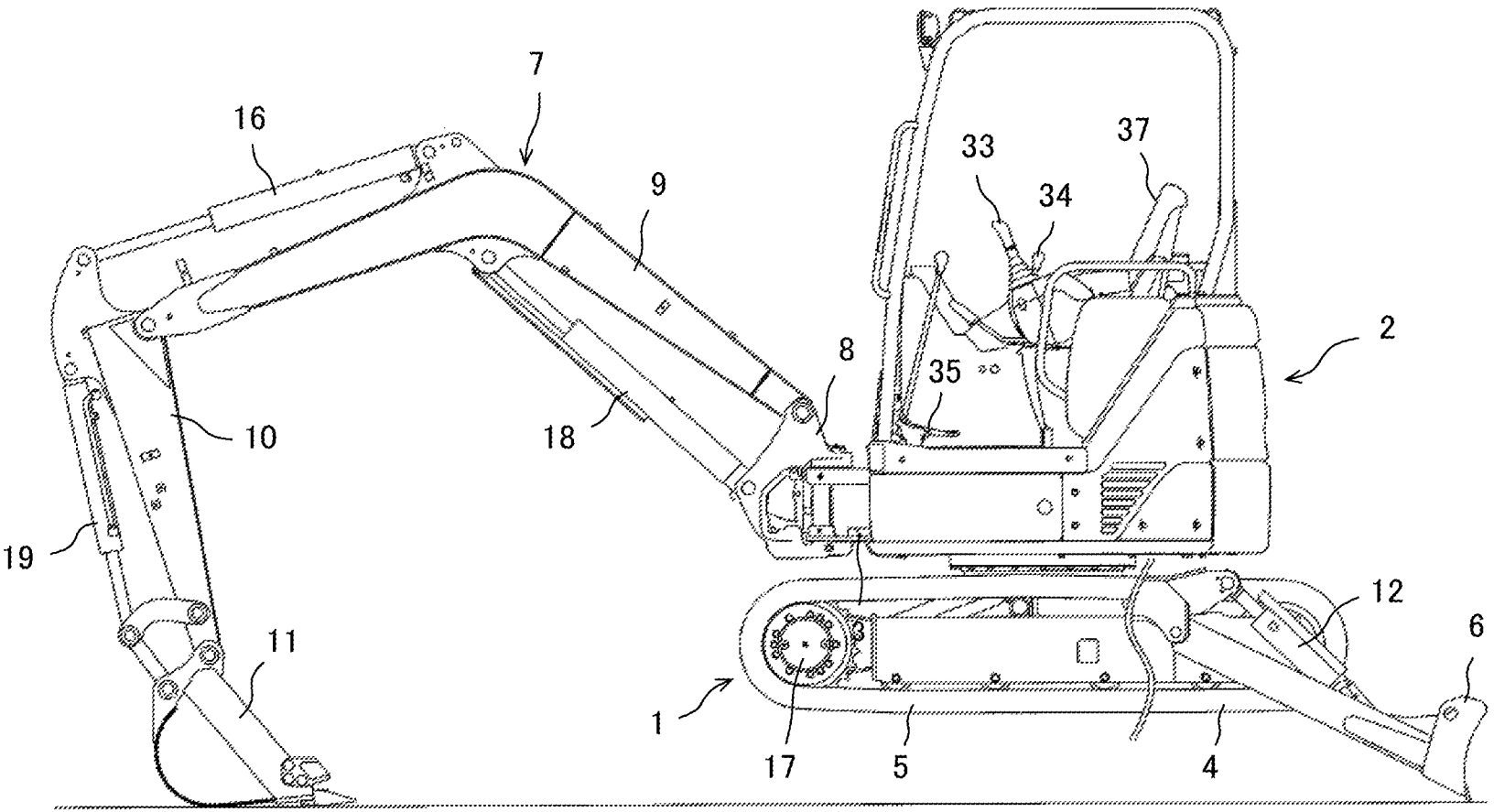
FIG. 5 is a side view depicting a state in which a machine body of the hydraulic excavator is jacked up in the embodiment of the present invention.

An operation in the case of jacking up the machine body of the hydraulic excavator as depicted in FIG. 5 will be described. First, when the hydraulic excavator is in the state depicted in FIG. 1, the operator operates the operation device 33 to reverse the upper swing structure 2 by 180 degrees. Then, the operator operates the operation devices 32 and 33 to change the posture of the work device 7 and to bring the bucket 11 into contact with the ground. Then, the operator operates the operation device 32 to lower the boom 9, thereby floating a rear portion of the lower track structure 1 from the ground. In addition, the operator operates the operation device 34 (operates in such a manner that the operation lever does not reach a detent position) to lower the blade 6, thereby floating a front portion of the lower track structure 1 from the ground. By this, the machine body is put into a jacked-up state.

In a state in which the blade 6 is jacking up the machine body, the pressure in the bottom-side oil chamber of the blade cylinder 12 is equal to or more than the setting value. In this case, even if the operator makes an erroneous operation (specifically, even if the blade operation device 34 is operated to the front side and its stroke s becomes equal to or more than the reference value s2), the controller 40 proceeds to step S104 via steps S101 and S102 in FIG. 4 above, and switches the solenoid selector valve 39 to the interruption position VI. By this, a pilot pressure p corresponding to the floating command is invalidated, and the blade control valve 22 is returned to the neutral position I. Therefore, the blade 6 is not put into a floating state.

Thereafter, the controller 40 holds the solenoid selector valve 39 in the interruption position VI until the operation lever of the blade operation device 34 is returned to the neutral position.

(2) Leveling Work

An operation in the case of performing leveling work by putting the blade 6 in a floating state will be described. When the blade 6 is not in the state of jacking up the machine body, the pressure in the bottom-side oil chamber of the blade cylinder 12 is less than the setting value. In this case, when the operator operates the blade operation device 34 to the front side and its stroke s becomes equal to or more than the reference value s2, the controller 40 proceeds to step S107 via steps S101 and S106 in FIG. 4 above, and holds the solenoid selector valve 39 in the communication position V. By this, a pilot pressure p corresponding to the floating command is validated, and the blade control valve 22 is switched to a floating position IV.

In the floating position IV of the blade control valve 22, the bottom-side oil chamber and the rod-side oil chamber of the blade cylinder 12 are made to communicate with the tank T. By this, the blade 6 is put into the floating state. In this instance, the blade 6 is lowered due to its own weight, to make contact with the ground. When the operator operates the operation device 35 to move the hydraulic excavator forward or backward, the blade can follow up to undulations, if any, of the ground, since the blade 6 is in the floating state. Therefore, favorable leveling work can be performed.

Thereafter, when the stroke s of the operation lever of the blade operation device 34 becomes less than the reference value s2, the controller 40 proceeds to step S104 via step S108 in FIG. 4 above, and switches the solenoid selector valve 39 to the interruption position VI. By this, a pilot pressure p corresponding to the lowering command is invalidated, and the blade control valve 22 is returned to the neutral position I. Further, thereafter, the controller 40 holds the solenoid selector valve 39 in the interruption position VI until the operation lever of the blade operation device 34 is returned to the neutral position.

In this way, in the present embodiment, in the case where the machine body is in a jacked-up state, even if the operator makes an erroneous operation (specifically, even if the blade operation device 34 is operated to the front side and its stroke s becomes equal to or more than the reference value s2), a pilot pressure p corresponding to the floating command is invalidated, and the blade control valve 22 is returned to the neutral position. In other words, the blade 6 is not put into the floating state, and lowering of the machine body can be prevented. On the other hand, in the case where the machine body is not in a jacked-up state, when the operator operates the blade operation device 34 to the front side and its stroke s becomes equal to or more than the reference value s2, the pilot pressure p corresponding to the floating command is validated, to switch the blade control valve 22 to the floating position IV. In other words, the bottom-side oil chamber and the rod-side oil chamber of the blade cylinder 12 are made to communicate with the tank T, to put the blade 6 into the floating state, and, therefore, favorable leveling work can be performed.

Further, in the present embodiment, since the stroke s of the operation lever of the blade operation device 34 is equal to or more than the prescribed value s2 and the machine body is in the jacked-up state, it is ensured, in the case where the solenoid selector valve 39 is switched to the interruption position VI (that is, in the case where the blade control valve 22 is returned to the neutral position I), that even if the stroke s of the operation lever of the blade operation device 34 thereafter becomes less than the prescribed value s2, the solenoid selector valve 39 is held in the interruption position VI until the operation lever is returned to the neutral position. By this, unlike in the case where the solenoid selector valve 39 is not held in the interruption position VI, a sudden transition of the blade control valve 22 from the neutral position I to the lowering position III (particularly, a state in which the opening area of a meter-in line and the opening area of a meter-out have been enlarged, if the stroke of the operation lever is large) can be prevented, and a sudden operation can be avoided.

In addition, in the present embodiment, since the stroke s of the operation lever of the blade operation device 34 is equal to or more than the prescribed value s2 and the machine body is not in a jacked-up state, it is ensured, in the case where the solenoid selector valve 39 is held in the communication position V (that is, in the case where the blade control valve 22 is switched to the floating position IV), that when the stroke s of the operation lever of the blade operation device 34 thereafter becomes less than the prescribed value s2, the solenoid selector valve 39 is switched to the interruption position VI, and, further, thereafter, the solenoid selector valve 39 is held in the interruption position VI until the operation lever is returned to the neutral position. By this, unlike in the case where the solenoid selector valve 39 is not switched to the interruption position VI, a sudden transition of the blade control valve 22 from the floating position IV to the lowering position III (particularly, a state in which the opening area of a meter-in line and the opening area of a meter-out have been enlarged, if the stroke of the operation lever is large) can be prevented, and a sudden operation can be avoided.

Note that in the embodiment above, description has been made taking as an example a case in which the pressure sensor 41 for detecting the pressure in the bottom-side oil chamber of the blade cylinder 12 is provided, and, based on whether or not the pressure detected by the pressure sensor 41 is equal to or more than the preset setting value and that state has continued for a preset predetermined period of time, it is determined by the controller 40 whether or not the blade 6 is in the state of jacking up the machine body; however, this is not limitative, and modifications are possible within the scope of the gist and technical idea of the present invention. Specifically, for example, a pressure sensor for detecting the pressure in the rod-side oil chamber of the blade cylinder 12 may be provided, and, based on whether or not the pressure detected by the pressure sensor is equal to or less than a preset setting value and that state has continued for a preset predetermined period of time, it may be determined by the controller whether or not the blade 6 is in the state of jacking up the machine body. Alternatively, for example, a first pressure sensor for detecting the pressure in the bottom-side oil chamber of the blade cylinder 12 and a second pressure sensor for detecting the pressure in the rod-side oil chamber of the blade cylinder 12 may be provided, and, based on whether or not the pressure detected by the first pressure sensor is equal to or more than a preset first setting value and the pressure detected by the second pressure sensor is equal to or less than a preset second setting value (provided that the second setting value<the first setting value), it may be determined by the controller whether or not the blade 6 is in the state of jacking up the machine body. In these modifications, also, effects similar to those in the embodiment above can be obtained.

In addition, in the embodiment above, description has been made taking as an example a case in which the blade operation device 34 generates a pilot pressure according to the stroke of the operation lever and outputs the pilot pressure to the blade control valve 22; however, this is not limitative, and modifications are possible within such ranges as not to depart from the gist and technical thought of the present invention. Specifically, a configuration may be adopted in which the blade operation device 34 detects the stroke of the operation lever and outputs the stroke to the controller, the controller generates a control signal according to the stroke of the operation lever and outputs the control signal to a solenoid proportional pressure reducing valve, and the solenoid proportional pressure reducing valve generates a pilot pressure according to the control signal and outputs the pilot pressure to the blade control valve. A processing for validating or invalidating the control signal may be conducted by the controller, in place of the solenoid selector valve 39 in the embodiment above, whereby validation and invalidation of the floating command and the lowering command may be switched. In these modifications, also, effects similar to those in the embodiment above can be obtained.

Besides, in the embodiment above, description has been made taking as an example a configuration (open center system) in which the control valves 22 to 29 are of the open center type and the hydraulic fluid is returned from the hydraulic pumps P1, P2, and P3 to the tank when the control valves are in neutral positions; however, this is not limitative, and modifications are possible within such ranges as not to depart from the gist and technical thought of the present invention. Specifically, there may be adopted a configuration (a closed center system with a load sensing control function) in which the control valves are of the closed center type and the hydraulic fluid is returned from the hydraulic pumps to the tank through unload valves when the control valves are in neutral positions.

In addition, in the embodiment above, description has been made taking as an example a case in which the three hydraulic pumps P1, P2, and P3 are provided as main pumps; however, this is not limitative, and modifications are possible within such ranges as not to depart from the gist and technical thought of the present invention. Specifically, it is sufficient that at least one hydraulic pump is provided.

Note that description has been made above taking as an example a case where the present invention is applied to a hydraulic excavator, but this is not limitative, and the present invention may be applied to other construction machines (specifically, for example, a wheel loader, etc.).

DESCRIPTION OF REFERENCE CHARACTERS

1: Lower track structure
2: Upper swing structure
6: Blade
12: Blade cylinder
22: Blade control valve
34: Blade operation device
34*a*, 34*b*: Pilot valve
38*a*, 38*b*: Pilot hydraulic line
39: Solenoid selector valve
40: Controller
41: Pressure sensor
42: Pilot pressure sensor
P1, P2, P3: Hydraulic pump
T: Tank

The invention claimed is:

1. A construction machine including a blade provided to be drivable in a vertical direction relative to a machine body, a blade cylinder that is operated by a hydraulic fluid delivered from a hydraulic pump and that drives the blade in the vertical direction, a blade control valve that switches to one of a neutral position for stopping the blade, a raising position for driving the blade in a raising direction, a lowering position for driving the blade in a lowering direction, and a floating position for setting the blade in a floating state, to thereby control a flow of the hydraulic fluid in relation to the blade cylinder, and a blade operation device that has an operation lever, that outputs a raising command for switching the blade control valve to the raising position when the operation lever is operated to one side, that outputs a lowering command for switching the blade control valve to the lowering position when the operation lever is operated to the other side and a stroke of the operation lever is less than a reference value, and that outputs a floating command for switching the blade control valve to the floating position when the operation lever is operated to the other side and a stroke of the operation lever is equal to or more than the reference value, the construction machine comprising:

a pressure sensor that detects a pressure in a bottom-side oil chamber of the blade cylinder; and a controller that switches between validation and invalidation of the floating command and the lowering command based on a result of detection by the pressure sensor, a predetermined value, preset as a pressure in the bottom-side oil chamber of the blade cylinder to be a reference for determining as to whether or not the blade is jacking up the machine body, being stored in the controller, the controller validating the floating command when the operation lever is operated to the other side and a stroke of the operation lever is equal to or more than the reference value, in a case where the pressure detected by the pressure sensor is less than the predetermined value, and invalidating the floating command when the operation lever is operated to the other side and a stroke of the operation lever is equal to or more than the reference value, and invalidating the lowering command until the stroke of the operation lever becomes less than the reference value and the operation lever is operated to the neutral position, in a case where the pressure detected by the pressure sensor is equal to or more than the predetermined value.

2. The construction machine according to claim 1, wherein the blade operation device includes a first pilot valve that generates a first pilot pressure corresponding to the raising command when the operation lever is operated to the one side, and outputs the first pilot pressure to the blade control valve through a first pilot hydraulic line to switch the blade control valve to the raising position, and a second pilot valve that generates a second pilot pressure corresponding to either of the lowering command and the floating command according to a stroke of the operation lever when the operation lever is operated to the other side, and outputs the second pilot pressure to the blade control valve through a second pilot hydraulic line to switch the blade control valve to either of the lowering position and the floating position, a solenoid selector valve having a communication position and an interruption position and a pilot pressure sensor for detecting the second pilot pressure are provided in the second pilot hydraulic line, a reference pilot pressure preset as a second pilot pressure to be a reference for determining as to whether or not the operation lever is operated to the other side and a stroke of the operation lever is equal to or more than the reference value, and a neutral pilot pressure preset as a second pilot pressure to be a reference for determining as to whether or not the operation lever is operated to the neutral position, are stored in the controller, and the controller holds the solenoid selector valve in the communication position to validate the second pilot pressure corresponding to the floating command when the second pilot pressure detected by the pilot pressure sensor is equal to or more than the reference pilot pressure, in a case where the pressure detected by the pressure sensor is less than the predetermined value, and switches the solenoid selector valve to the interruption position to invalidate the second pilot pressure corresponding to the floating command when the second pilot pressure detected by the pilot pressure sensor is equal to or more than the reference pilot pressure, and holds the solenoid selector valve in the interruption position to invalidate the second pilot pressure corresponding to the lowering command until the second pilot pressure detected by the pilot pressure sensor becomes less than the reference pilot pressure and becomes the neutral pilot pressure, in a case where the pressure detected by the pressure sensor is equal to or more than the predetermined value.

3. The construction machine according to claim 2, wherein the controller holds the solenoid selector valve in the communication position to validate the second pilot pressure corresponding to the floating command when the second pilot pressure detected by the pilot pressure sensor is equal to or more than the reference pilot pressure, and switches the solenoid selector valve to the interruption position to invalidate the second pilot pressure corresponding to the lowering command until the second pilot pressure detected by the pilot pressure sensor becomes less than the reference pilot pressure and becomes the neutral pilot pressure, in a case where the pressure detected by the pressure sensor is less than the predetermined value.

* * * * *